US006412240B1

(12) United States Patent
Treleven et al.

(10) Patent No.: US 6,412,240 B1
(45) Date of Patent: Jul. 2, 2002

(54) HIGH PERFORMANCE FLASHING ASSEMBLY

(75) Inventors: Patrick T. Treleven, Lawrenceville; Kyle A McDaniel, Alpharetta, both of GA (US)

(73) Assignee: Kawneer Company, Inc., Norcross, GA (US)

( * ) Notice: Subject to any disclaimer, the term of this patent is extended or adjusted under 35 U.S.C. 154(b) by 16 days.

(21) Appl. No.: 09/625,434

(22) Filed: Jul. 25, 2000

(51) Int. Cl.[7] ..... E06B 3/00

(52) U.S. Cl. ..... 52/208; 52/204.53; 52/204.54; 52/204.55; 52/204.591; 52/204.593; 52/204.595; 52/204.599; 52/204.6

(58) Field of Search ..... 52/208, 204.53, 52/204.54, 204.55, 204.591, 204.593, 204.595, 204.599, 204.6

(56) References Cited

U.S. PATENT DOCUMENTS

| | | | | | |
|---|---|---|---|---|---|
| 3,204,324 | A | * | 9/1965 | Nilsen | 52/97 |
| 4,267,673 | A | * | 5/1981 | Coulston | 52/97 |
| 4,619,097 | A | * | 10/1986 | Trummer et al. | 52/730 |
| 4,750,310 | A | | 6/1988 | Holcombe | 52/731 |
| 5,325,633 | A | | 7/1994 | Magoon | 49/504 |
| 5,787,659 | A | | 8/1998 | Rinehart | 52/209 |

* cited by examiner

*Primary Examiner*—Lanna Mai
*Assistant Examiner*—Dennis L. Dorsey
(74) *Attorney, Agent, or Firm*—Glenn E. Klepac

(57) ABSTRACT

A flashing assembly includes a sill horizontal, a sill flashing for attaching the assembly to a substrate, and at least one sill clip for interconnecting the sill horizontal and the sill flashing. The sill horizontal, sill flashing, and sill clip all preferably include aluminum alloy extrusions. The sill clip connects the sill horizontal to the sill flashing without through fasteners.

19 Claims, 5 Drawing Sheets

HIGH PERFORMANCE FLASHING ASSEMBLY

FIELD OF THE INVENTION

The present invention relates to a flashing assembly for building walls, storefronts, curtain walls, windows, and the like.

BACKGROUND OF THE INVENTION

Flashing assemblies for storefronts and other building areas having large windows are known in the prior art. However, the earlier flashing assemblies suffer from one or more serious disadvantages making them less than entirely suitable for their intended purpose.

Flashing assemblies generally include a sill flashing or flashing plate for attachment to a sill, and a sill horizontal for supporting a window. The sill flashing and the sill horizontal are preferably both made from aluminum alloy extrusions. The sill flashing is attached to a wood sill or other substrate by through fasteners, generally metal screws or bolts.

A window frame including a sill horizontal is set onto the sill flashing after it is attached to the substrate. Then holes are drilled through the sill horizontal and into the sill flashing. Fasteners are then installed through the sill horizontal in order to anchor the window frame to the substrate.

In order to minimize the potential for leaks, the installer must pump a sealant through the hole in the sill horizontal and hope to hit the area of the hole in the sill flashing. A sealant is then applied to the fastener, and the fastener is installed through both holes. Because of the possibility of leaks occurring in assemblies having through fasteners penetrating both the sill horizontal and sill flashing, there still remains a need for a flashing assembly eliminating those undesirable features.

A principal objective of the present invention is to provide a flashing assembly having a sill horizontal attached to sill flashing without any through fasteners.

A related objective of the invention is to provide a flashing assembly wherein blind seals are avoided.

Another objective of the invention is to provide a flashing assembly that can be installed easily.

A further objective of the invention is to provide a flashing assembly having improved water pressure performance. The flashing assembly of the invention also has improved structural performance so that its resistance to wind damage is enhanced.

Additional objectives and advantages of our invention will become apparent to persons skilled in the art from the following detailed description of a particularly preferred embodiment.

SUMMARY OF THE INVENTION

In accordance with the present invention there is provided a flashing assembly for building walls, storefronts, curtain walls, windows and the like.

The flashing assembly of our invention includes a sill horizontal, a sill flashing, and at least one sill clip for joining the sill horizontal to the sill flashing. The sill horizontal, sill flashing, and sill clip may be manufactured from various metals, fiber reinforced plastics, wood, or other materials capable of being shaped into a desired configuration. All three principal components are preferably made of metal and in a particularly preferred embodiment they all include aluminum alloy extrusions.

The sill horizontal is preferably part of a window frame that also includes laterally spaced first and second window mullions joined to opposed, laterally spaced, first and second lateral end portions of the sill horizontal. The frame also includes a top rail spaced upwardly of the sill horizontal. The mullions and the top rail preferably include aluminum alloy extrusions. The window frame circumscribes a window, preferably a double glazed or monolithic (single glazed) glass window.

A preferred sill horizontal includes a sill top wall for supporting a window pane, a sill face attached to the sill top wall and extending downwardly therefrom, a forwardly extending back flange attached to the sill face, a sill front wall attached to the sill top wall and extending downwardly therefrom, and a rearwardly extending front flange attached to the sill front wall. The sill horizontal is mechanically attached to vertically extending frame members such as mullions or jambs. For example the sill horizontal may be attached to a mullion by a metal clip, by metal screws held in a spline formed integrally with the sill horizontal, or by welding.

A preferred sill flashing includes a front wall, a front web attached to the front wall, and a channel connected with the front web and extending downwardly thereof. The channel is defined by a channel front wall connected with the front web, a channel rear wall, and a channel bottom wall extending between the channel front wall and rear wall.

In a particularly preferred embodiment the sill horizontal and sill flashing each comprise an aluminum alloy extrusion. When desired, both structures may also include a thermal isolator or thermal break for reducing heat transfer. The thermal isolator includes an insulating plastic material such as polyurethane (PU), polyvinyl chloride (PVC) or acrylonitrile-butadiene-styrene (ABS).

The thermal isolator is typically manufactured by the "pour/debridge" method, described in greater detail in U.S. Pat. Nos. 3,204,324 and 4,619,097, incorporated herein by reference to the extent consistent with the present invention. The method involves pouring a quantity of a thermally insulating plastic resin into an open groove in the extrusion. The extrusion initially includes a metal bar or bridge interconnecting front and rear parts of the extrusion. When the plastic resin cures into a solid, rigid state and the metal bridge is removed, the resin forms a connector between the front and rear parts. The two metal parts remain joined together even though the bridge is gone. Thus, a composite structure is formed in which the two aluminum alloy parts are thermally insulated from one another by the plastic thermal break material.

It is desirable to provide a mechanical interlock between the two aluminum parts and the plastic thermal break material so that the structural integrity of the composite is not entirely dependent upon adhesive bonding between the plastic and aluminum elements. Accordingly, projections are formed in the extrusions extending inwardly of the groove holding the plastic insulating material. The projections prevent displacement of the aluminum parts with respect to the plastic thermal break material in response to tensile and shear forces.

The sill clip of the invention may be metal or plastic and is preferably an aluminum alloy extrusion. A preferred flashing assembly includes laterally spaced, first and second sill clips adjacent opposed, laterally. spaced first and second lateral end portions of the sill horizontal. The sill clips preferably have a length of only a few inches whereas lengths of the sill horizontal and sill flashing generally range between a few feet and several feet. A particularly preferred sill clip has a length of about 3 inches (7.5 cm).

The sill clip includes a shelf and at least one foot extending downwardly from the shelf The shelf includes a front edge portion for supporting the front flange of the sill horizontal and a back edge portion for supporting the back flange of the sill horizontal. The sill clip also preferably includes a front foot extending downwardly into the channel of the sill flashing adjacent the channel front wall and a rear foot extending downwardly into the channel adjacent the channel rear wall The sill clip is preferably interlocked with the sill horizontal and the sill flashing. In a particularly preferred embodiment the front flange of the sill horizontal includes a rearwardly extending front tab for insertion into a front groove defined by the sill clip shelf. The back flange of the sill horizontal includes a forwardly extending back tab for insertion into a back groove defined by the sill clip shelf A front foot on the sill clip includes a forwardly extending projection and the channel front wall supports a web having a portion extending rearwardly over the projection. The sill flashing preferably includes a sill face adjacent a lower portion of the sill back wall on the sill horizontal.

The sill horizontal has opposed, laterally spaced first and second end portions. The first and second end portions are attached to vertically extending mullions, either by mechanical means or by welding. Preferably, both end portions include screw splines for attaching the sill horizontal to a mullion with metal screw fasteners. Optionally, the sill clip may also include laterally opening screw splines for connecting the clip to a mullion with metal screw fasteners.

The flashing assembly allows the resultant end reaction from wind loading on a building wall to be transferred to the sill flashing through the sill clip. The resultant end reaction is distributed through the bearing contact of the mullion and the downwardly extending J-shaped feet of the sill clips into the channel of the sill flashing. Resistance to wind damage is improved by converting the resultant end reaction into shear stress rather than bending.

DETAILED DESCRIPTION OF PREFERRED EMBODIMENTS

Figure 1:
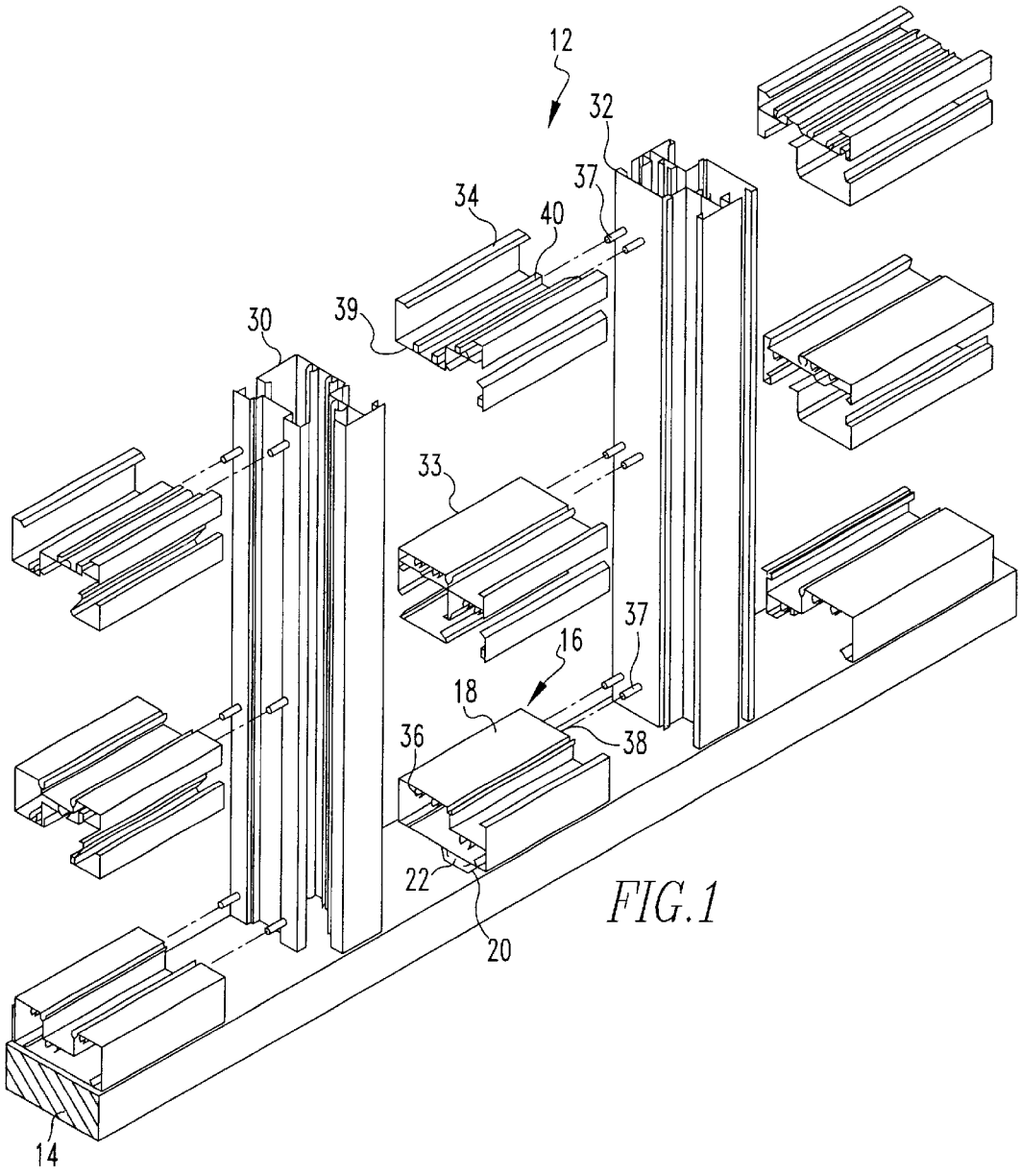
FIG. 1 is an exploded, perspective view of a storefront window including a preferred flashing assembly of the present invention.

High performance flashing assemblies of the present invention are useful for building walls, storefronts, curtain walls, windows, and the like. FIG. 1 shows a storefront window frame 12 attached to a wood substrate 14 by a high performance flashing assembly 16 of our invention.

The flashing assembly 16 includes a sill horizontal 18, sill flashing 20 attached to the substrate 14, and a sill clip 22 connecting the sill horizontal 18 and the sill flashing 20. A frame 12 is made up of the sill horizontal 18, a first mullion 30, a second mullion 32, and a head 34. The sill horizontal 18, mullions 30, 32, intermediate horizontal 33, and head 34 all include anodized aluminum alloy extrusions. The sill flashing 20 preferably includes an aluminum alloy extrusion having an anodized or painted surface finish, and the sill clip 22 is preferably an aluminum alloy extrusion having no surface finish. The sill horizontal 18 includes a first end portion 36 attached to the first mullion 30 by steel screws 37, and a second end portion 38 attached to the second mullion 32 by steel screws 37. The head 34 includes opposed lateral end portions 39 and 40 attached to the mullions 30 and 32 by steel screws 37.

Figure 2:
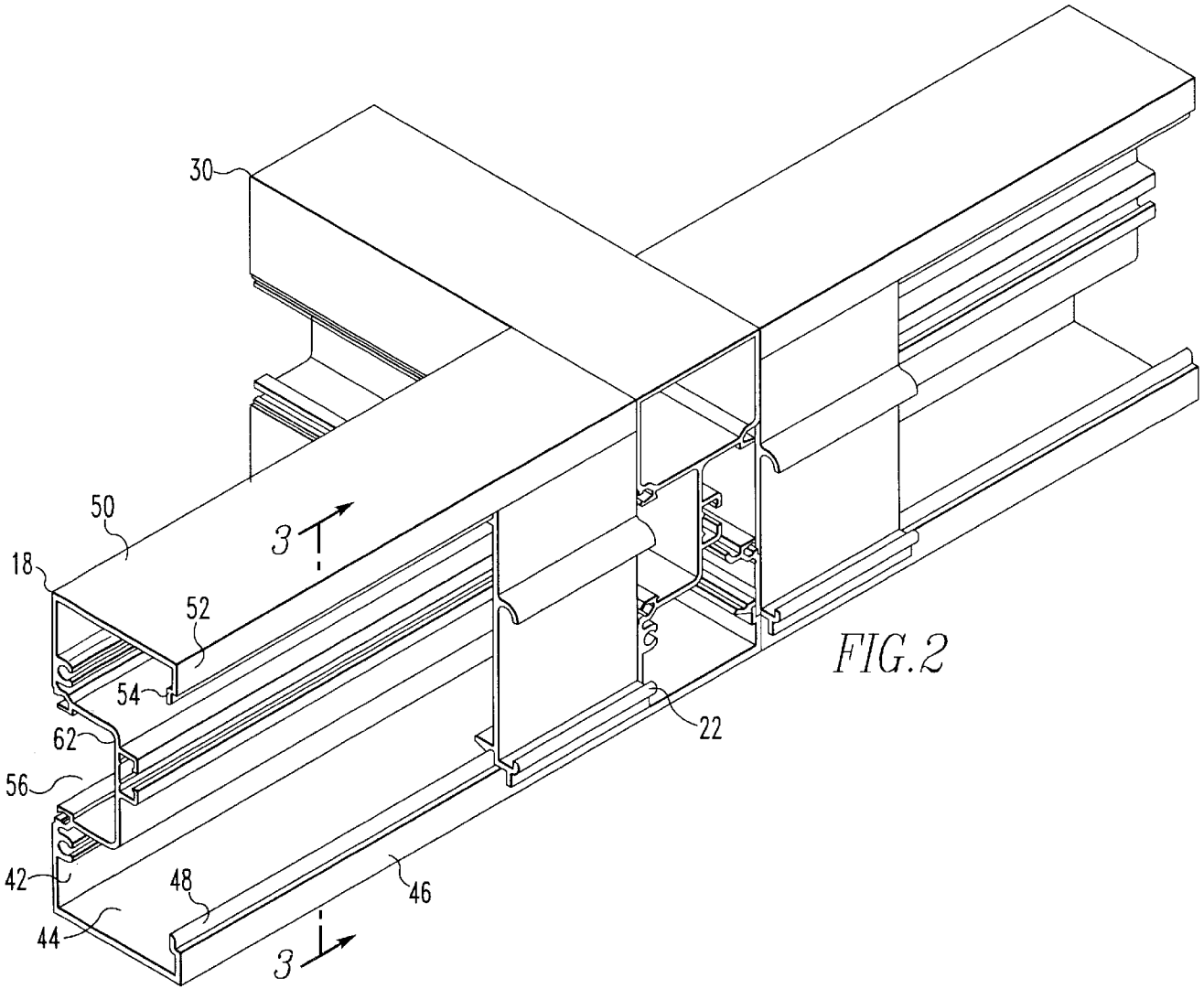
FIG. 2 is a fragmentary, isometric view of a flashing assembly of the present invention.
Figure 3:
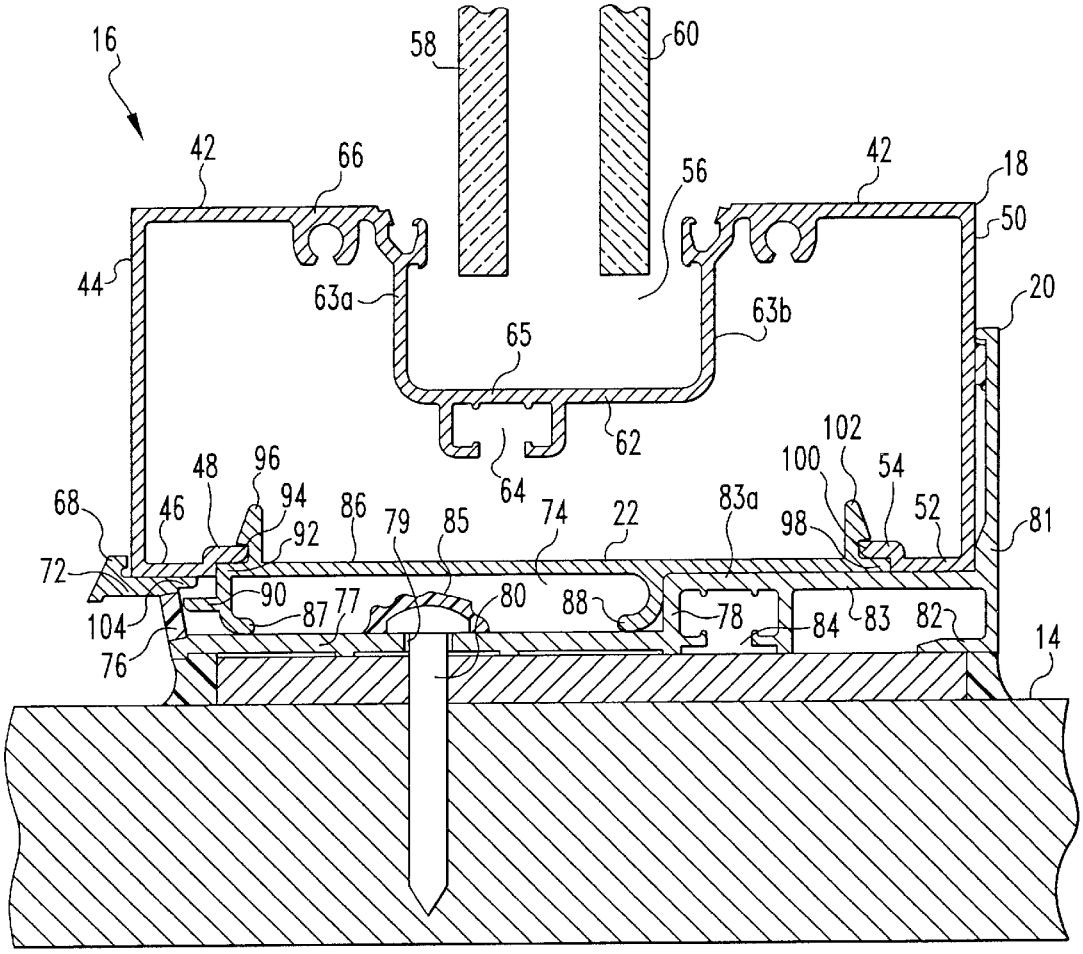
FIG. 3 is a cross-sectional view taken along the lines 3—3 of FIG. 2.

Referring now to FIGS. 2 and 3, the sill horizontal 18, sill flashing 20, and sill clip 22 of the flashing assembly 16 are shown in greater detail. The sill horizontal 18 includes a sill top wall 42, a downwardly extending sill front wall 44 attached to the top wall 42, and a rearwardly extending front flange 46 attached to the sill front wall 44. The front flange 46 ends in a rearwardly extending front tab 48. The sill horizontal 18 also includes a sill back wall 50 attached to the sill top wall 42, and a forwardly extending back flange 52 attached to the sill back wall 50 at its bottom. The back flange 52 ends in a forwardly directed back tab 54. The sill top wall 42 defines a depression 56 for glass window panes 58 and 60. The depression 56 includes a bottom wall 62 and side walls 63*a*, 63*b*. In an alternative embodiment of the invention, a pocket 64 below the bottom wall 62 is filled with a PU thermal insulator (not shown) and a strip 65 of metal adjacent the pocket 64 is removed. Interrupting the top wall 42 with the thermal isolator reduces heat transfer by conduction through the top wall 42 of the flashing assembly 16.

The top wall 42 also supports two screw splines 66 for connecting the sill horizontal 18 with metal screws to one or both of the mullions. 30, 32 shown in FIG. 1.

The sill flashing 20 includes a front wall 68, a front web 72 extending rearwardly from the front wall 68, and a channel 74. The channel 74 includes a channel front wall 76, a channel bottom wall 77, and a channel rear wall 78. The channel bottom wall 77 defines an opening 79. A threaded steel screw 80 extends through the opening 79. into the wood substrate 14. A head of the screw 80 is covered with a sealant 85.

The sill flashing 20 also includes a sill face or rear wall 81 ending in a forwardly extending bottom flange 82. A rear web 83 extends forwardly above the bottom flange, between the sill face 81 and the channel rear wall 78. If desired, a pocket 84 below the rear web 83 may be filled with a PU thermal isolator (not shown) and a narrow metal strip 83a above the pocket 84 is removed, thereby reducing conductive heat transfer through the sill flashing 20.

The sill horizontal 18 and the sill flashing 20 are connected by two laterally spaced metal sill clips 22. Each sill clip 22 includes a shelf 86, a generally J-shaped front foot 87 extending downwardly from the shelf 86 into the channel 74, and a generally J-shaped rear foot 88 also extending downwardly from the shelf 86 into the channel 74. The front foot 87 sits upon the channel bottom wall 77 adjacent the channel front wall 76. The rear foot 88 sits upon the channel bottom wall 77 adjacent the channel rear wall 78. A small projection 90 extends forwardly of the front foot 87, abutting against the channel front wall 76.

The shelf 86 includes a front edge portion 92 supporting a front tab 48 extending rearwardly from the front flange 46 of the sill horizontal 18. The front tab 48 is seated in a. front groove 94 defined by a front retaining wall 96 extending upwardly of the front edge portion 92. The shelf 86 also has a back edge portion 98 for supporting a back tab 54 extending from the back flange 52 of the sill horizontal 18. The back tab 54 is seated in a back groove 100 defined by a back retaining wall 102 extending upwardly of the back edge portion 98.

The channel front wall 76 supports a front web 72 including a back part 104 extending rearwardly over the projection 90 on the front foot 87. The front web 72 also supports the front wall 68, extending upwardly from the web 72 adjacent a bottom part of the sill front wall 44.

Figure 4:
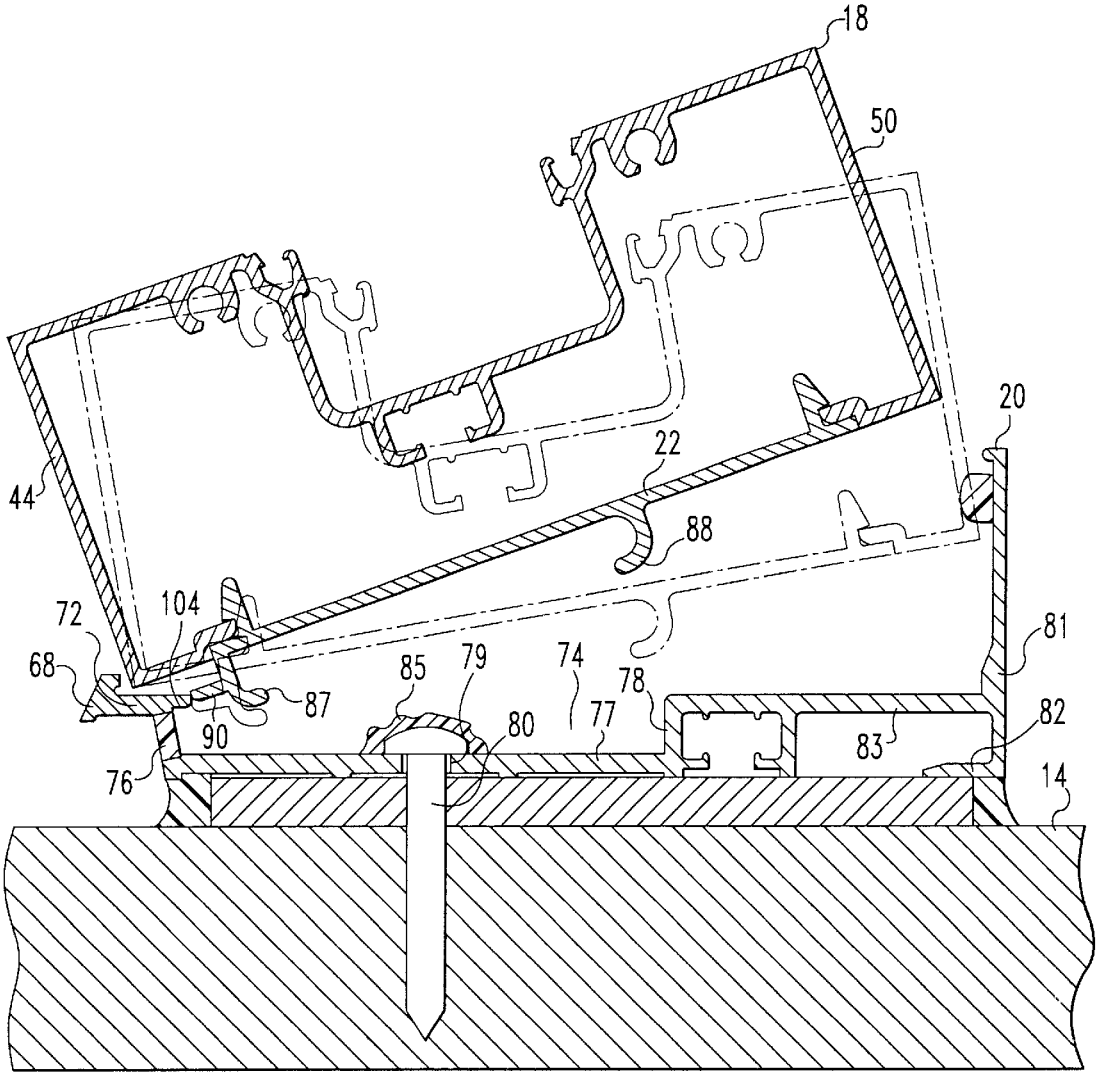
FIG. 4 is a cross-sectional view similar to FIG. 3.

FIG. 4 shows one step in putting together the flashing assembly 16. First, the sill flashing 20 is attached to a wood substrate 14 by metal screw fasteners 80 extending through openings 79 in the channel bottom wall 77. Heads of the fasteners 80 are covered by a sealant 85. After the sill clips 22 are connected with the sill horizontal 18, the front foot 87 is positioned in the channel 74, with the projection 90 below the back part 104 of the strip 72. Initially, the sill back wall 50 of the sill horizontal 18 is tilted upwardly, away from the sill face 81 of the sill flashing 20. Finally, the sill back wall 50 is lowered to rest next to the sill face 81, with both feet 87 and 88 residing inside the channel 74.

A preferred sill flashing assembly of our invention has an increased dam height, thereby improving water pressure performance.

Figure 5:
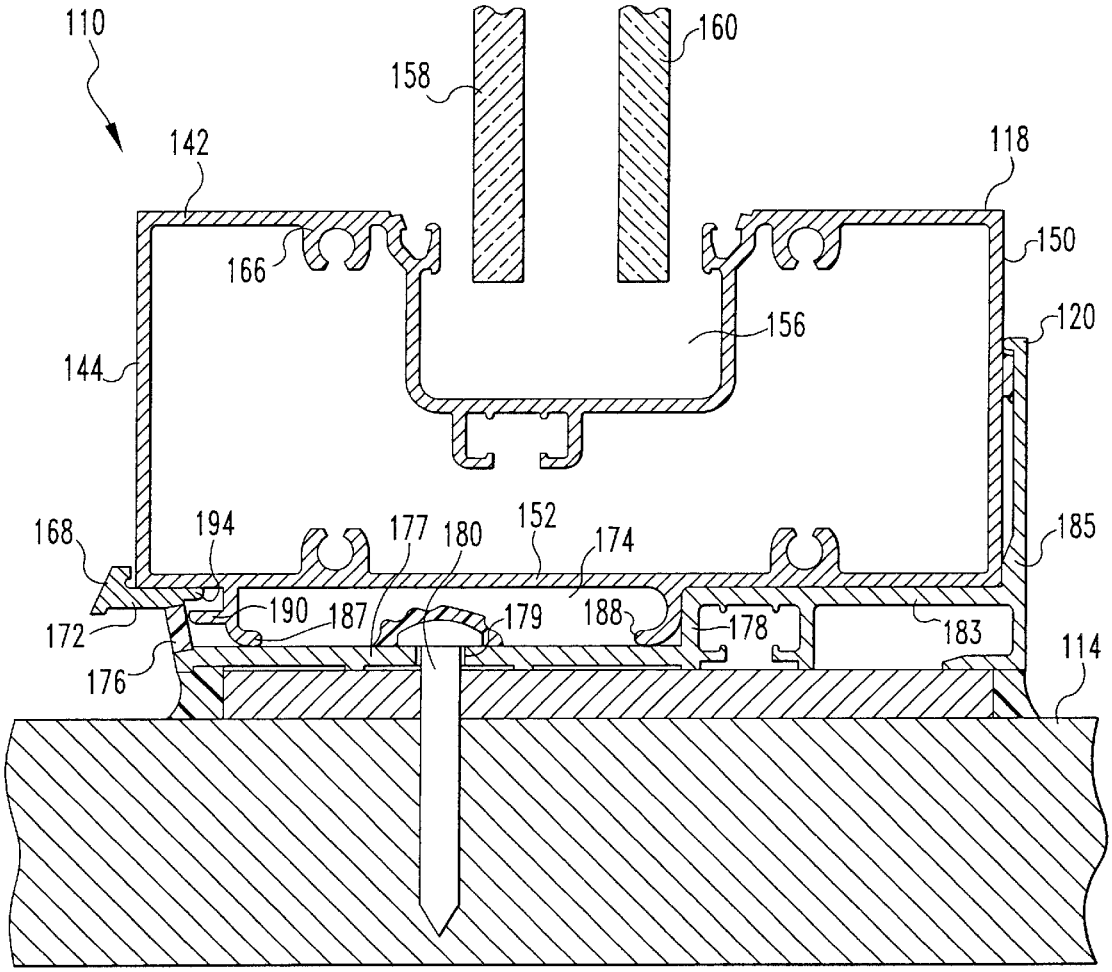
FIG. 5 is a cross-sectional view of an alternative flashing assembly of the invention.

An alternative embodiment of a flashing assembly 110 of the invention is shown in FIG. 5, fastened to a wood substrate 114. The assembly 110 includes a sill horizontal 118 and a sill flashing 120, both made from aluminum alloy extrusions. The sill clip is eliminated by incorporating its structural features into the sill horizontal 118.

The sill horizontal 118 includes a sill top wall 142, a sill front wall 144 and a sill back wall 150, both extending downwardly from the sill top wall 142, and a sill lower wall 152 extending between the sill front wall 144 and sill back wall 150. The sill top wall 142 defines a depression 156 for glass windowpanes 158, 160. The sill top wall 142 and bottom wall 152 both include screw splines 166 for connecting the sill horizontal 118 to mullions (not shown).

The sill flashing 120 includes a front wall 168, a front web 172 extending rearwardly from the front wall 168, and a channel 174. The channel 174 includes a channel front wall 176 attached to the front web 172, a channel bottom wall 177, and a channel rear wall 178. The channel bottom wall 177 defines an opening 179. A threaded steel screw 180 extends through the opening 179 into the wood substrate 114. A rear web 183 connects the channel rear wall 178 with a sill face 185.

Two generally J-shaped legs 187, 188 extend downwardly from the sill lower wall 152 into the channel 174. Bottom portions of the legs 187, 188 rest upon the channel bottom wall 177. The front leg 187 includes a forwardly extending projection 190 abutting against the channel front wall 176. A small part 194 of the front web 172 extends rearwardly, over the projection 190. The back leg 188 is adjacent the channel back wall 178.

The foregoing detailed description of our invention has been made with reference to some particularly preferred embodiments. Persons skilled in the art will understand that numerous changes and modification in the invention can be made without departing from the spirit and scope of the following claims.

What is claimed is:

1. A flashing assembly comprising:

(a) a sill horizontal comprising:

(i) a sill top wall;

(ii) a sill front wall attached to said sill top wall and extending downwardly thereof;

(iii) a rearwardly extending front flange attached to said sill front wall;

(iv) a sill back wall. attached to said sill top wall and extending downwardly thereof; and (v) a forwardly extending back flange attached to said sill back wall;

(b) a sill flashing for attaching the flashing assembly to a substrate, comprising:

(i) a front wall;

(ii) a front web attached to said front wall and extending rearwardly thereof;

(iii) a channel including a channel front wall connected with the front web, a channel rear wall, and a channel bottom wall extending between the channel front wall and the channel rear wall; and (iv) a sill face spaced from said front wall; and (c) at least one sill clip for interconnecting said sill flashing and said sill horizontal without through fasteners, said sill clip comprising:

(i) a shelf including a front edge portion for supporting said front flange and a back edge portion for supporting said back flange; and (ii) at least one foot extending downwardly from said shelf into said channel.

2. The flashing assembly of claim 1 wherein said sill top wall defines a depression for supporting a window.

3. The flashing assembly of claim 1 wherein said sill horizontal is mechanically connected to a mullion.

4. The flashing assembly of claim 1 wherein said front flange includes a rearwardly extending front tab, said front edge portion of said shelf defines a front groove, and said front tab is sized and positioned for insertion into said front groove.

5. The flashing assembly of claim 1 wherein said back flange includes a forwardly extending back tab, said back edge portion of said shelf defines a back groove, and said back tab is sized and positioned for insertion into said back groove.

6. The flashing assembly of claim 1 wherein said sill horizontal comprises an aluminum alloy extrusion.

7. The flashing assembly of claim 1 wherein said sill top wall includes a pocket between said sill front wall and said sill back wall, said pocket containing a non-metallic thermal isolator.

8. The flashing assembly of claim 1 wherein said sill flashing comprises an aluminum alloy extrusion.

9. The flashing assembly of claim 1 wherein said sill face of the sill flashing includes a rearwardly extending bottom flange for supporting the sill flashing on a substrate.

10. The flashing assembly of claim 1 wherein said sill clip comprises an aluminum alloy extrusion.

11. The flashing assembly of claim 1 wherein said sill clip includes a front foot adjacent said channel front wall and a rear foot adjacent said channel rear wall.

12. The flashing assembly of claim 1 wherein said sill clip includes a front foot adjacent said channel front wall, said front foot includes a forwardly extending projection and said channel front wall supports a web having a part extending over said projection.

13. The flashing assembly of claim 1 wherein sill horizontal includes a lateral end portion, and further comprising:

d) a mullion adjacent each said lateral end portion; and e) at least one fastener for attaching said mullion to said sill horizontal.

14. The flashing assembly of claim 1 wherein said sill horizontal and said sill flashing each include a first lateral end portion and a second lateral end portion spaced laterally of said first lateral end portion, and further compromising:

d) a first mullion adjacent said first lateral end portion of the sill horizontal;

e) a second mullion adjacent said second lateral end portion of the sill horizontal;

and wherein said sill clip comprises a first sill clip adjacent said first mullion and a second sill clip adjacent said second mullion, said second sill clip being spaced laterally. of said first sill clip.

15. A flashing assembly comprising:

(a) a sill horizontal comprising an aluminum alloy extrusion, said sill horizontal including laterally spaced first and second lateral end portions:

(b) a sill flashing for attaching the flashing assembly to a substrate and comprising:

(i) a front wall and a rear wall, said front wall and said rear wall each comprising an aluminum alloy extrusion; and (ii) a thermal isolator comprising a non-metallic material connecting said front wall and said rear wall;

(c) a first sill clip adjacent said first lateral end portion for connecting said sill horizontal and said sill flashing without through fasteners, said first sill clip comprising an aluminum alloy extrusion; and (d) a second sill clip adjacent said second lateral end portion for connecting said sill horizontal and said sill flashing without through fasteners, said second sill clip comprising an aluminum alloy extrusion laterally spaced from said first sill clip.

16. The flashing assembly of claim 15 wherein said thermal isolator comprises a plastic material.

17. A flashing assembly comprising:

(a) a sill flashing for attaching the flashing assembly to a substrate, comprising:

(i) a front wall;

(ii) a front web attached to the front wall and extending rearwardly thereof;

(iii) a channel including a channel front wall connected with the front web, a channel rear wall, and a channel bottom wall extending between the channel front wall and channel rear wall, said channel bottom wall being spaced downwardly of said front web;

(iv) a sill face spaced from said front wall; and (v)a rear web connecting said sill face and said channel rear wall; and (b) a sill horizontal comprising:

(i) a sill top wall;

(ii) a sill front wall attached to said sill top wall and extending downwardly therefrom;

(iii) a sill back wall attached to said sill top wall and extending downwardly therefrom;

(iv) a sill lower wall extending between said sill front wall and sill back wall;

(v) a front foot extending downwardly of said sill lower wall into said channel adjacent the channel front wall; and (vi) a rear foot extending downwardly of said sill lower wall into said channel adjacent the channel rear wall.

18. The flashing assembly of claim 17 wherein said front foot includes a forwardly extending projection and said front web on the sill flashing includes a portion extending rearwardly over said projection.

19. The flashing assembly of claim 17 wherein said front foot and said rear foot are generally J-shaped.

* * * * *